US007648087B2

(12) United States Patent
Horn et al.

(10) Patent No.: US 7,648,087 B2
(45) Date of Patent: Jan. 19, 2010

(54) SPRAY NOZZLE ASSEMBLY

(75) Inventors: Michael Horn, Oldendorf (DE); Oskar Pittl, Neuengors (DE)

(73) Assignee: Aerosol Inventions and Development S.A., Majuro (MH)

( * ) Notice: Subject to any disclaimer, the term of this patent is extended or adjusted under 35 U.S.C. 154(b) by 182 days.

(21) Appl. No.: 11/832,117

(22) Filed: Aug. 1, 2007

(65) Prior Publication Data

US 2008/0029621 A1 Feb. 7, 2008

(30) Foreign Application Priority Data

Aug. 5, 2006 (DE) ..... 10 2006 036 762

(51) Int. Cl.
*B05B 1/00* (2006.01)

(52) U.S. Cl. ..... 239/597; 239/594; 239/598; 239/601; 239/DIG. 19

(58) Field of Classification Search ..... 239/589, 239/592, 594, 597, 598, 600, 601, DIG. 19
See application file for complete search history.

(56) References Cited

U.S. PATENT DOCUMENTS

| | | | | |
|---|---|---|---|---|
| 3,647,147 | A * | 3/1972 | Cook | 239/601 |
| 4,346,849 | A | 8/1982 | Rood | 239/597 |
| 5,178,325 | A * | 1/1993 | Nielsen | 239/589 |
| 5,288,027 | A * | 2/1994 | Herstek et al. | 239/594 |
| 5,642,860 | A * | 7/1997 | Bush et al. | 239/333 |
| 5,655,255 | A | 8/1997 | Kelly | |
| 5,676,311 | A | 10/1997 | Hartman | |
| 6,261,367 | B1 * | 7/2001 | Donges | 239/597 |
| 2003/0178506 | A1 | 9/2003 | Kondou | |

FOREIGN PATENT DOCUMENTS

| | | |
|---|---|---|
| DE | 27 32 314 | 1/1978 |
| DE | 27 34 950 | 2/1979 |
| GB | 2 047 571 A | 12/1980 |

* cited by examiner

*Primary Examiner*—Steven J Ganey
(74) *Attorney, Agent, or Firm*—Vidas Arrett & Steinkraus

(57) ABSTRACT

A spray nozzle assembly for atomizing a medium through a nozzle channel, comprising a first channel portion which is tapered by two lateral surfaces facing each other to form an elongate narrow cross-sectioned surface, a passage orifice disposed in the narrow cross-sectioned surface the cross-sectional area of which is smaller than is the narrow cross-sectioned surface, and a second channel portion adjoining the passage orifice in the direction of medium flow which has two opposed lateral surfaces separating from each other with an increase in distance from the passage orifice, whose edges facing the passage orifice extend crosswise to the longitudinal direction of the narrow cross-sectioned surface, characterized in that the nozzle channel having the two channel portions and the passage orifice are configured inside an integrally formed plastic component.

10 Claims, 7 Drawing Sheets

SPRAY NOZZLE ASSEMBLY

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Such spray nozzle assemblies serve for atomizing a medium, e.g. a perfume, varnish or other liquid. The medium requiring atomization is introduced into the nozzle channel of the spray nozzle assembly by means of a propellant or pumping mechanism here. Because of the peculiar geometry of the nozzle channel, the medium first undergoes condensation, flows through a small passage orifice, and escapes in the form of small droplets on the other side of the nozzle channel. The geometry of the nozzle channel is decisive for the spraying characteristics of the spray nozzle assembly here. Depending on use, very different properties regarding the droplets and their distribution in the spray jet may be desired, e.g. a flat spraying fan which concentrates the droplets in the fan centre or distributes them across the extent of the spraying fan in another, predetermined manner.

A spray nozzle assembly having the features of the preamble of claim 1 has been known from the U.S. Pat. No. 4,646,849, the entire contents of which is incorporated herein by reference. The known spray nozzle assembly is composed of a spraying nozzle and a holder. The two components are made of a metal and are brazed to each other. In particular, a very hard material which preferably is sintered tungsten carbide, is utilized for the spraying nozzle. The spraying nozzle is manufactured from a small cylindrical portion of this material by grinding a wedge-shaped groove into the pressure-end circle area of the cylinder and a trapezoidal groove, which extends perpendicularly to the wedge-shaped groove, into the opposed circle area of the cylinder. The two interengaging grooves form a passage orifice in the middle. The spraying nozzle is then inserted into a holder, which is also made of a metal, and is brazed thereto. The holder has formed therein a cylinder-shaped channel which leads to the wedge-shaped groove of the spraying nozzle. The known spraying nozzle, which is also called a cross-recessed nozzle, helps achieve beneficial spraying characteristics even though the known spray nozzle assembly is very expensive in manufacture.

Accordingly, it is the object of the invention to provide a spray nozzle assembly which has favourable spraying characteristics and can also be manufactured economically in large numbers.

BRIEF SUMMARY OF THE INVENTION

The inventive spray nozzle assembly for atomizing a medium through a nozzle channel comprises a first channel portion which is tapered by two lateral surfaces facing each other to form an elongate narrow cross-sectioned surface, a passage orifice disposed in the narrow cross-sectioned surface the cross-sectional area of which is smaller than is the narrow cross-sectioned surface, and a second channel portion adjoining the passage orifice in the direction of medium flow which has two opposed lateral surfaces separating from each other with an increase in distance from the passage orifice, whose edges facing the passage orifice extend crosswise to the longitudinal direction of the narrow cross-sectioned surface, wherein the nozzle channel having the two channel portions and the passage orifice is configured inside an integrally formed plastic component.

The first channel portion is tapered by two lateral surfaces facing each other to form an elongate narrow cross-sectioned surface. The narrow cross-sectioned surface my have any shape here, specifically a curvature or a line-up of differently oriented portions. The tapering cross-section of the first channel portion causes a medium which streams in to be condensed initially. After flowing through the passage orifice, the medium passes into the adjoining second channel portion which has two opposed lateral surfaces separating from each other with an increase in distance from the passage orifice. Therefore, the cross-section of the second channel portion widens in the direction of flow, which makes well-defined atomization easier. The edges facing the passage orifice extend crosswise to the longitudinal direction of the narrow cross-sectioned surface. Hence, the two cross-sections formed each by the two lateral surfaces of the first and second channel portions will cross each other at tight angles, for example. Since the entire spray nozzle assembly is manufactured as a plastic element it may be produced integrally in an injection moulding process, for example. As compared to the known spray nozzle assembly, it thus becomes unnecessary to work the spray nozzle individually and place it in a separate holder.

The invention relies on the finding that using a particularly hard material for the spray nozzle as is provided for wear reduction according to the state of the art is unnecessary for many applications. It is specifically for equipping sprayers or atomizers, which are intended for a single fill, with a spraying head that an inventive spray nozzle assembly completely made from a plastic will meet the requirements as well.

An example of application is to spray non-diluted olive oil in the airless process by using a spraying head comprising an inventive spray nozzle assembly, e.g. for spraying oil onto salads.

In a preferred aspect of the invention, the second channel portion is limited, between its two lateral surfaces, by two bordering surfaces disposed to be approximately perpendicular to the plane of the passage orifice which are at a lateral distance from the passage orifice. Those additional bordering surfaces allow to further control and efficiently act on the spray jet. In a particularly preferred aspect of the invention, the bordering surfaces are arranged approximately on the jacket of an imaginary cylinder the longitudinal axis of which extends perpendicularly to the plane of the passage orifice. It has been shown that this helps in bringing about a particularly favourable spraying behaviour.

According to a further preferred aspect of the invention, the nozzle channel comprises a third channel portion adjoining the second channel portion which has two lateral surfaces each of which extends in the plane of one of the two lateral surfaces of the second channel portion, and which is limited by two bordering surfaces disposed to be approximately perpendicular to the plane of the passage orifice between the two lateral surfaces of the third channel portion which are disposed at a lateral distance from the bordering surfaces of the second channel portion and are farther remote from the passage orifice than those are. The third channel portion creates a further portion of the nozzle channel the expansion of which in the direction of flow in one direction corresponds to the expansion of the second channel portion while a step is formed in the direction perpendicular thereto between the second and third channel portions. The geometrical configuration of the second and third channel portions, particularly that of the step that forms, farther allows to efficiently take an influence on the spraying behaviour.

It is preferred that the nozzle channel comprises a fourth channel portion which is disposed in front of the first channel portion in the direction of flow and adjoins the first channel portion and which is cylindrical in cross-section. This fourth channel portion allows introducing the medium to be sprayed into the spray nozzle assembly. It is notable that even this channel portion is formed as a single piece with the integrally formed plastic element. This permits to configure the spray nozzle assembly in such a way that a smaller number of components are needed for an installation in a spraying head.

According to a further preferred aspect of the invention, the narrow cross-sectioned surface, on either side of the passage orifice, has a portion disposed substantially in the plane of the passage orifice. Preferably, the narrow cross-sectioned surface has two further portions which adjoin the two portions of the narrow cross-sectioned surface disposed laterally of the passage orifice, and which are inclined towards the first channel portion from the plane of the passage orifice. An accurate design of the channel portion directing the medium to the passage orifice is of particular significance for the flow conditions of the medium and also for the resultant spraying behaviour. It has been shown that the so-called configuration of the narrow cross-sectioned surface helps achieve a particularly advantageous spraying behaviour.

According to a further preferred aspect of the invention, two webs project from the narrow cross-sectioned surface adjacent to the passage orifice, which extend into the first channel portion. Preferably, the webs extend in the direction of the lateral surfaces of the second channel portion. The webs cause a beneficial vortex of the flow immediately before it passes through the passage orifice. This helps achieve a particularly advantageous spraying behaviour.

According to a further preferred aspect of the invention, the spray nozzle assembly is manufactured from polyoxymethylene (POM), polybutylene terephthalate (PBT), polyethylene terephthalate (PET), polyamide (PA) and/or polypropylene (PP). The plastics mentioned excel in having particular beneficial properties in processing and use.

BRIEF DESCRIPTION OF SEVERAL VIEWS OF THE DRAWINGS

The invention will be described in more detail below with reference to two embodiments illustrated by seven figures.

In the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated Components which match each other in the different figures and both embodiments are given like reference figures.

Figure 1:
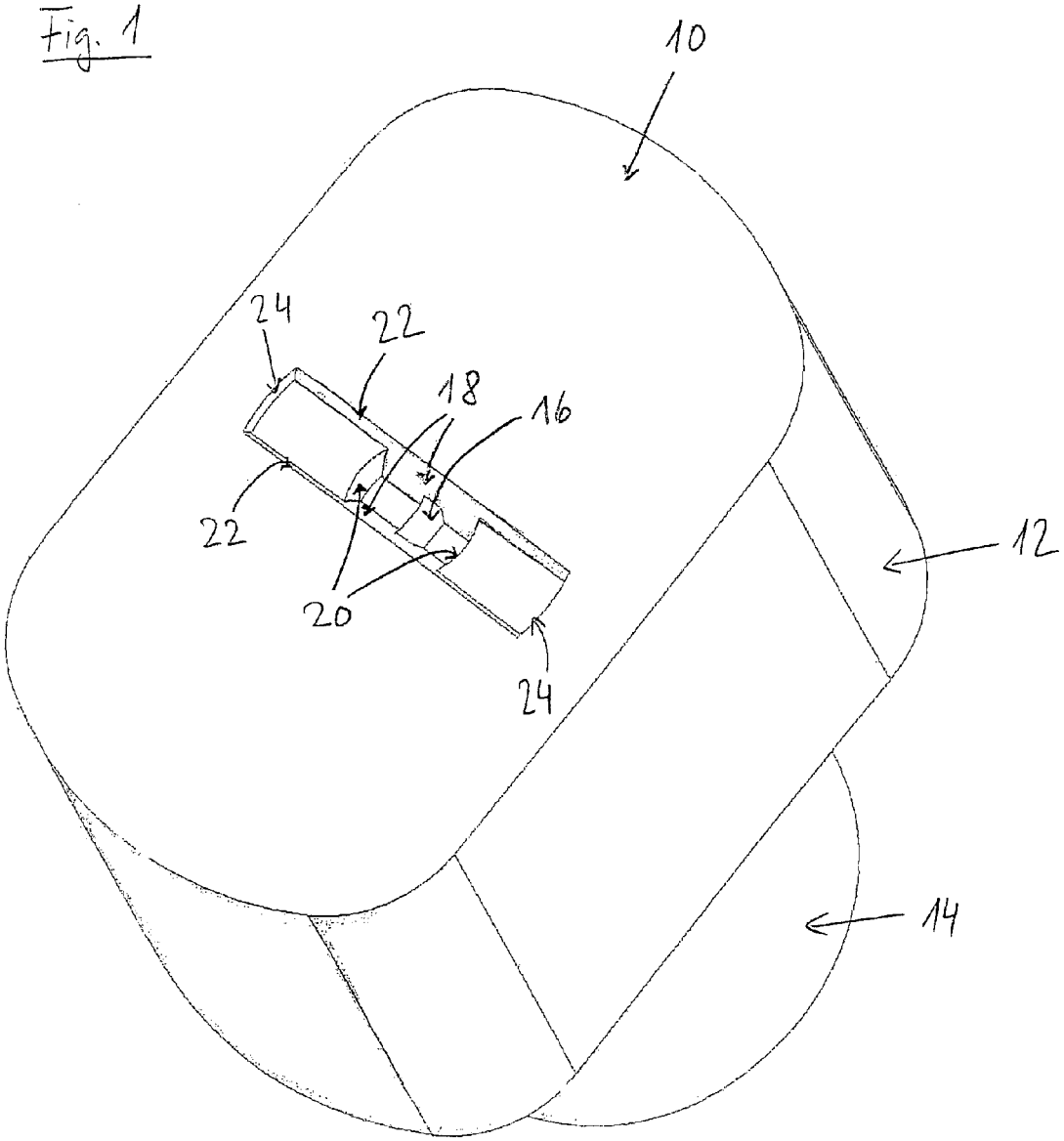
FIG. 1 shows a perspective view of an inventive spray nozzle assembly.

FIG. 1 shows an inventive spray nozzle assembly in a perspective view from top. The spray nozzle assembly which has the nozzle channel extending in the middle terminates in a level, approximately rectangular outer surface 10 having two rounded sides and intensely rounded corners. An approximately ashlar block 12 and a cylindrical portion 14 extend adjacent to the outer surface 10.

The nozzle channel, the passage orifice 16 of which can be seen in the view of FIG. 1, extends inside the spray nozzle assembly and along the longitudinal assembly thereof. A medium to be sprayed is led through a first, invisible channel portion and through the passage orifice 16. Adjacent to the passage orifice 16, there is a second channel portion which is confined by two lateral surfaces 18 which are opposed to each other and withdraw from each other with an increasing distance from the passage orifice, and two bordering surfaces disposed to be approximately perpendicular to the plane of the passage orifice 16. The two bordering surfaces 20 are arranged on the jacket of an imaginary cylinder the longitudinal axis of which extends perpendicularly to the plane of the passage orifice 16.

Adjacent to the second channel portion, there is a third channel portion which is confined by two lateral surfaces 22 which smoothly pass over into a lateral surface 18 each of the second channel portion, and two bordering surfaces 24 which are disposed to be approximately parallel to the bordering surfaces 20 of the second channel portion, but are disposed at a lateral distance therefrom and are offset outwardly. Because of the described arrangement of the lateral and bordering surfaces, the nozzle channel continuously widens in the area of the second and third channel portions, proceeding from the passage orifice 16 in the direction of flow. The third channel portion opens into the level outer surface 10 so that the nozzle channel terminates altogether on this outer surface.

The two bordering surfaces 20 of the second channel portion define a step between the second and third channel portions.

The lateral surfaces 22 of the third channel portion are substantially wider than are its bordering surfaces 24 so that the third channel portion is of an approximately rectangular, extended cross-section. The lateral surfaces 22 of the third channel portion extend perpendicularly to the longer edge of the level outer surface 10.

Figure 2:
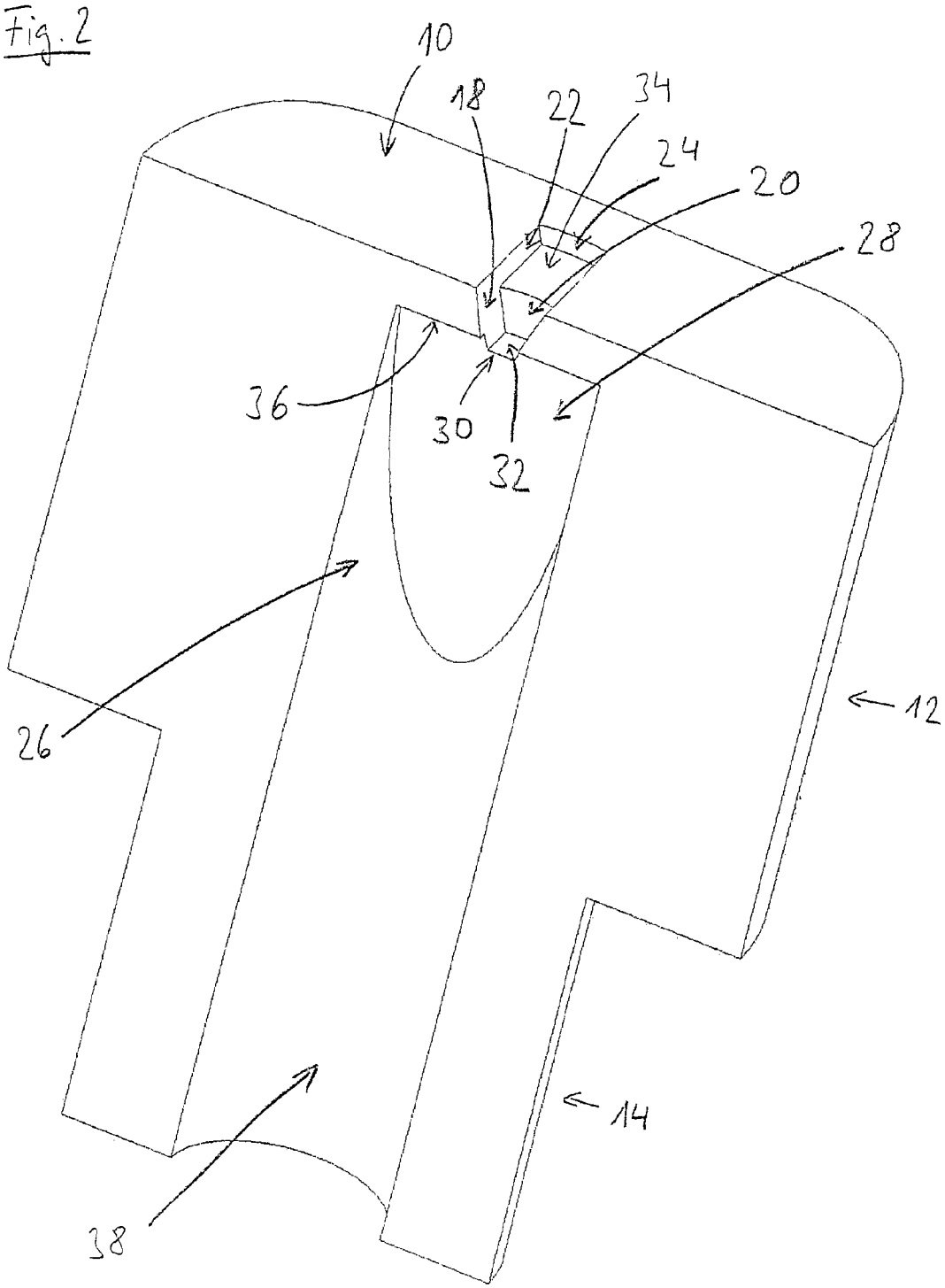
FIG. 2 shows a perspective view of the splay nozzle assembly of FIG. 1 as sectioned along its longitudinal axis.

The perspective sectional representation of FIG. 2 shows the spray nozzle assembly of FIG. 1 wherein the sectional plane extends along the longitudinal axis of the nozzle channel, i.e. centrally through the passage orifice 16, and in the direction of the longer edge of the level outer surface 10.

This view allows to recognize the lateral surfaces 18 and 22 and the bordering surfaces 20 and 24 of the second and third channel portions. An edge of the passage orifice 16 can be identified at 30. This edge is joined by a flat bottom surface 32 of the second channel portion that is disposed in parallel with the outer surface 10. Another flat bottom surface 34 is located between the bordering surfaces 20 and 24 of the second and third channel portions. A first channel portion 26 is located in the direction of flow below the passage orifice 16. The channel has two lateral surfaces facing each other, one of which can be seen having the reference FIG. 28, Because of the two lateral surfaces facing each other, the first channel portion tapers up to a narrow cross-sectioned surface 36 of which FIG. 2 only allows to see the central line extending along the elongate, narrow cross-sectioned surface. The narrow cross-sectioned surface extends at either side of the passage orifice 16 in parallel with the outer surface 10. Unless defined by the lateral surfaces 28, the wall of the first channel portion 26 is cylindrical.

Also provided with a cylindrical cross-section is a fourth channel portion 38. This fourth channel portion 38 serves for introducing the medium to be sprayed and smoothly passes over into the first channel portion.

Figure 3:
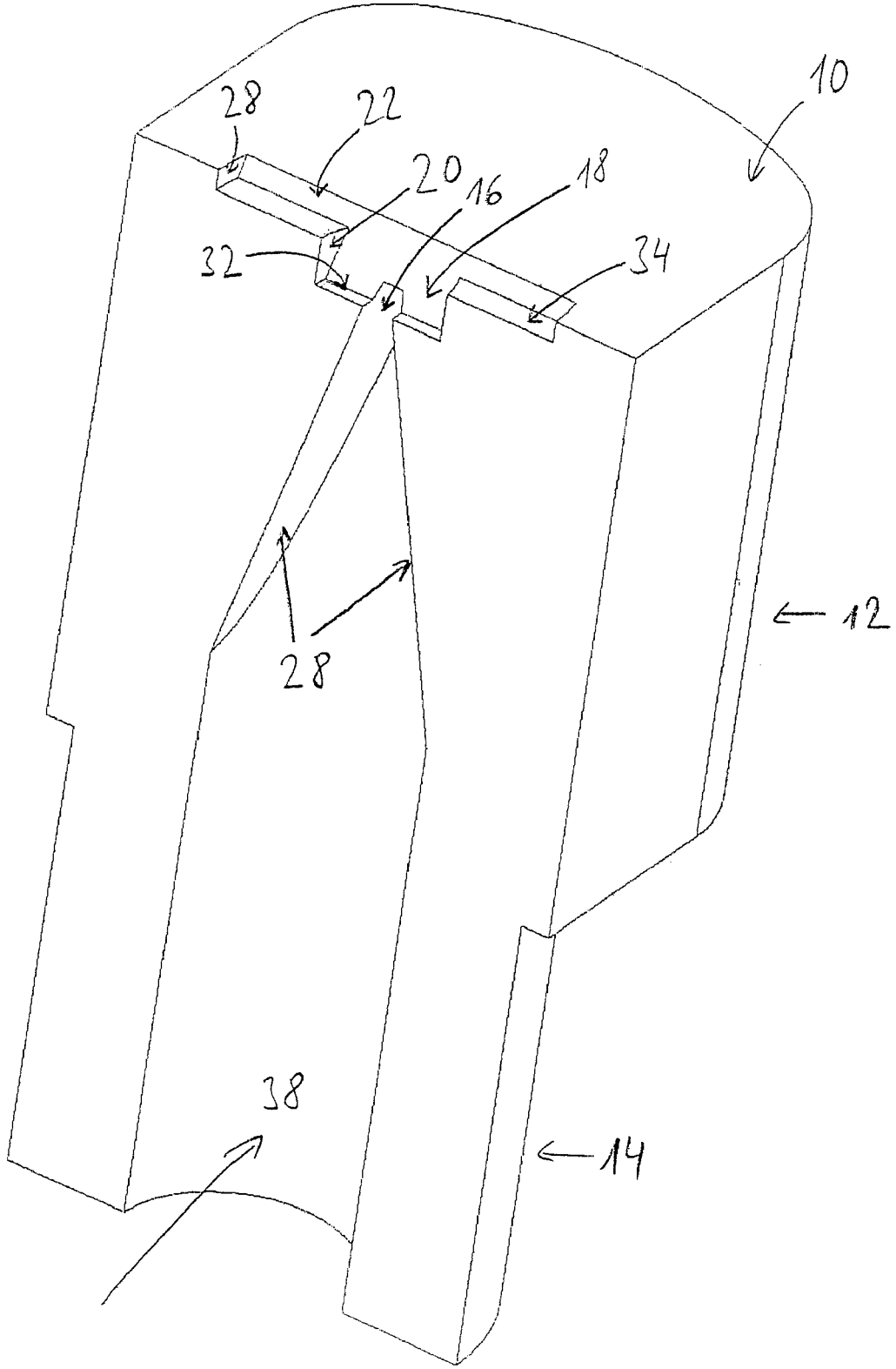
FIG. 3 shows a perspective view of the spray nozzle assembly of FIG. 1 as sectioned along its longitudinal axis with the sectional plane extending perpendicularly to that of FIG. 2.

The spray nozzle assembly of FIGS. 1 and 2 is illustrated in a further view in the representation of FIG. 3 where the sectional plane also extends along the longitudinal axis of the spray nozzle assembly, but is perpendicular to the sectional plane used in FIG. 2. Like in FIG. 2, it can be seen in FIG. 3 that the edges of the lateral surfaces 28 and lateral surfaces 18 that face the passage orifice 16 are perpendicular to each other so that the cross-sectional surfaces of the first and second channel portions which are approximately rectangular in the area of the passage orifice form a cross.

Figure 4:
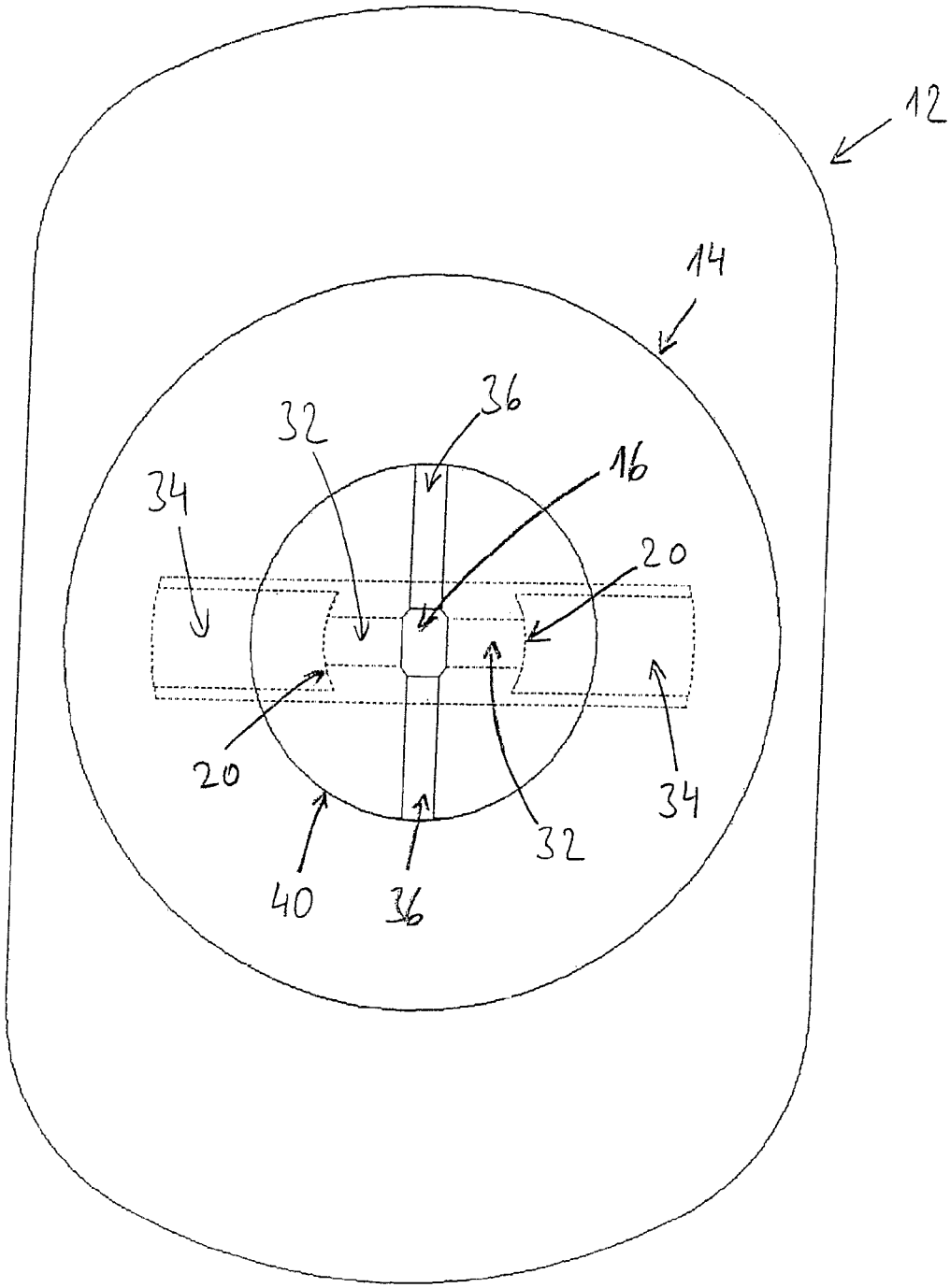
FIG. 4 shows a bottom plane view of the spray nozzle assembly of FIG. 1.

This cruciform arrangement can also be recognized in FIG. 4 where the spray nozzle arrangement is illustrated in a view from below, i.e. in the direction of the streaming medium. This view makes it particularly easy to identify the two portions of the narrow cross-sectioned surface 36 that are disposed at either side of the passage orifice 16.

Shown in a phantom line are the two flat bottom surfaces 32 which also adjoin the passage orifice 16 and extend in a direction perpendicular to the narrow cross-sectioned surface 36. The two first flat bottom surfaces 34 and the bordering surfaces 20 disposed in a circle segment fashion can be seen as well. The circle designated 40 indicates the inner circumference of the cylindrical fourth channel portion 38.

Figure 5:
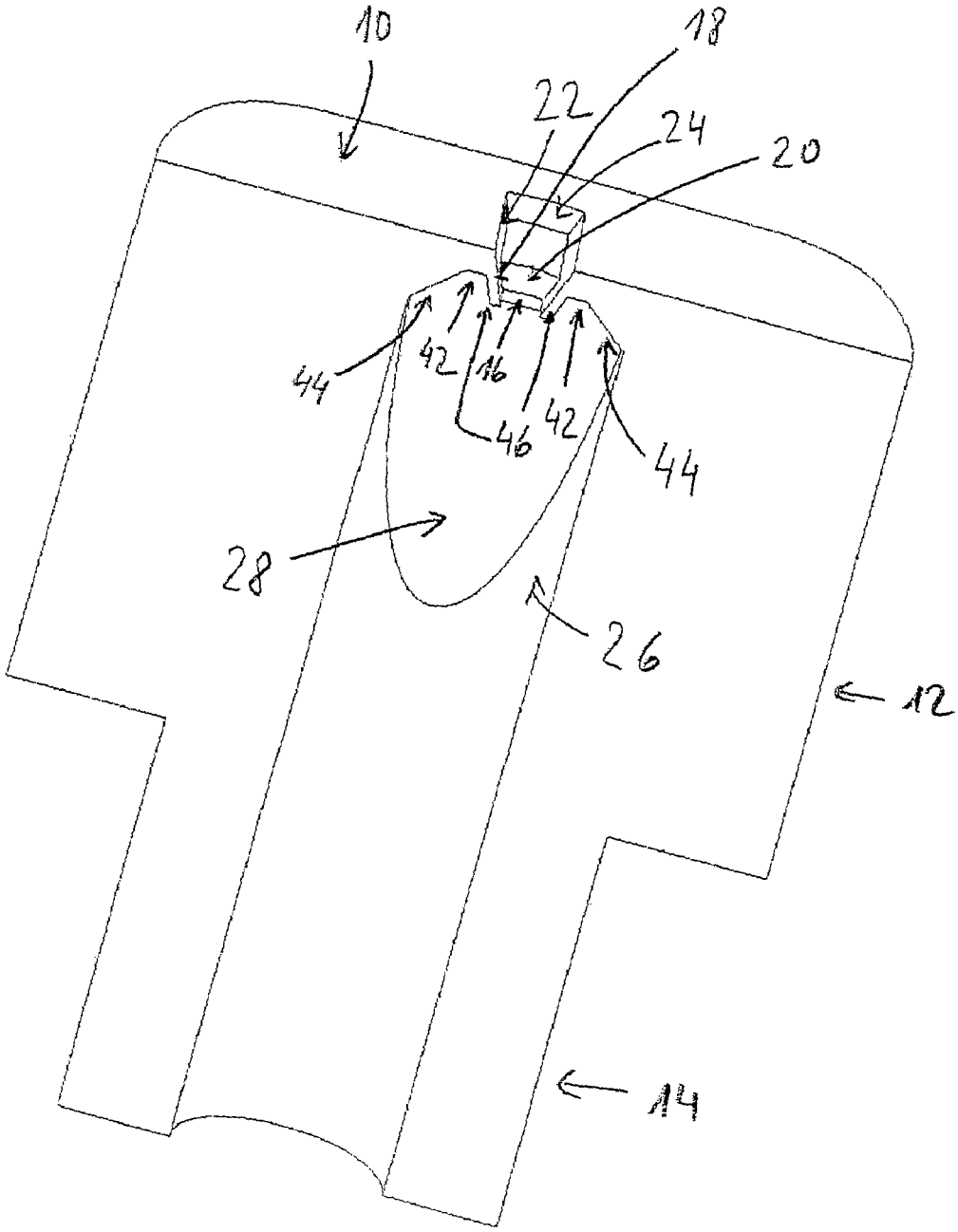
FIG. 5 shows a perspective view of a second embodiment of the inventive assembly as sectioned along the longitudinal axis of the nozzle channel.

In FIG. 5, a further embodiment of the invention is shown where the view and sectional plane roughly match with those of FIG. 2. Except for the design of the channel portions arranged around the passage orifice 16, the second embodiment is identical to that of FIG. 1. In contrast to the first embodiment, the narrow cross-sectioned surface 36 which is confined by the two converging lateral surfaces 28 of the first channel portion does not run completely in a plane, however. On either side of the passage orifice 16, the narrow cross-sectioned surface 36 rather has a first portion 42 which extends approximately in the plane of the passage orifice 16 and in parallel with the outer surface 10, and a second portion 44, which adjoins the first portion 42 and is inclined towards the first channel portion 26 from the plane of the passage orifice 16.

As a further particularity, on either side of the passage orifice 16, there is a web 46 projecting from a first portion 42 of the narrow cross-sectioned surface 36 which extends into the first channel portion. Each web 46 runs in the direction of one of the two lateral surfaces 18 of the second channel portion. Because of the specific configuration of the narrow cross-sectioned surface with the webs and inclined portions 44, a vortex is achieved for the medium to be sprayed in the area of the first channel portion before it flows through the passage orifice 16.

Figure 6:
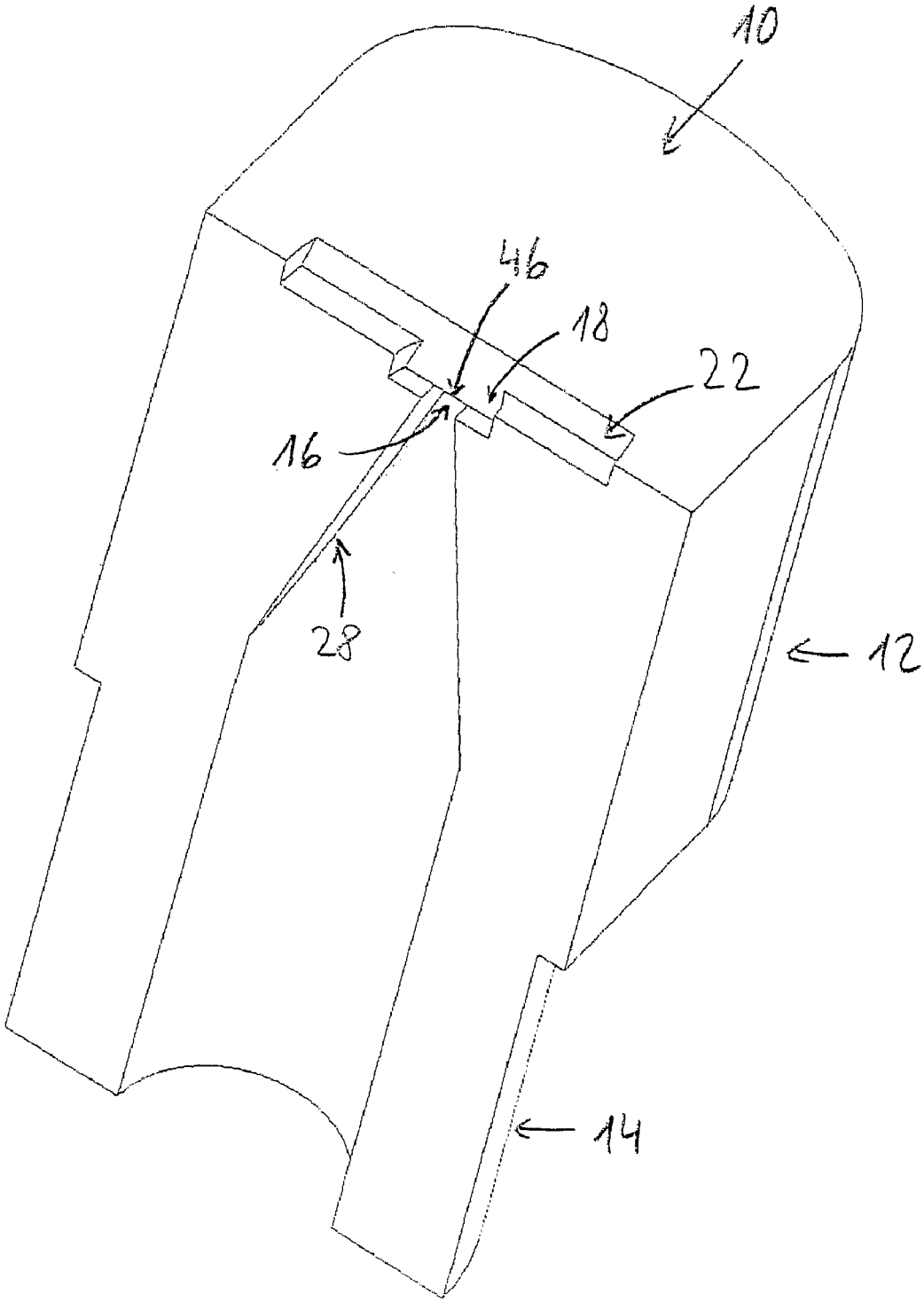
FIG. 6 shows a perspective view of the second embodiment of a spray nozzle assembly as sectioned along the longitudinal axis of the nozzle channel, with the sectional plane extending perpendicularly to that of FIG. 5.

The view of FIG. 6, the sectional plane of which extends perpendicularly from that of FIG. 5, allows recognizing the lateral surfaces 18 and 22 of the second and third channel portion and one side of the closely adjoining web 46 which marks off the passage orifice 16.

Figure 7:
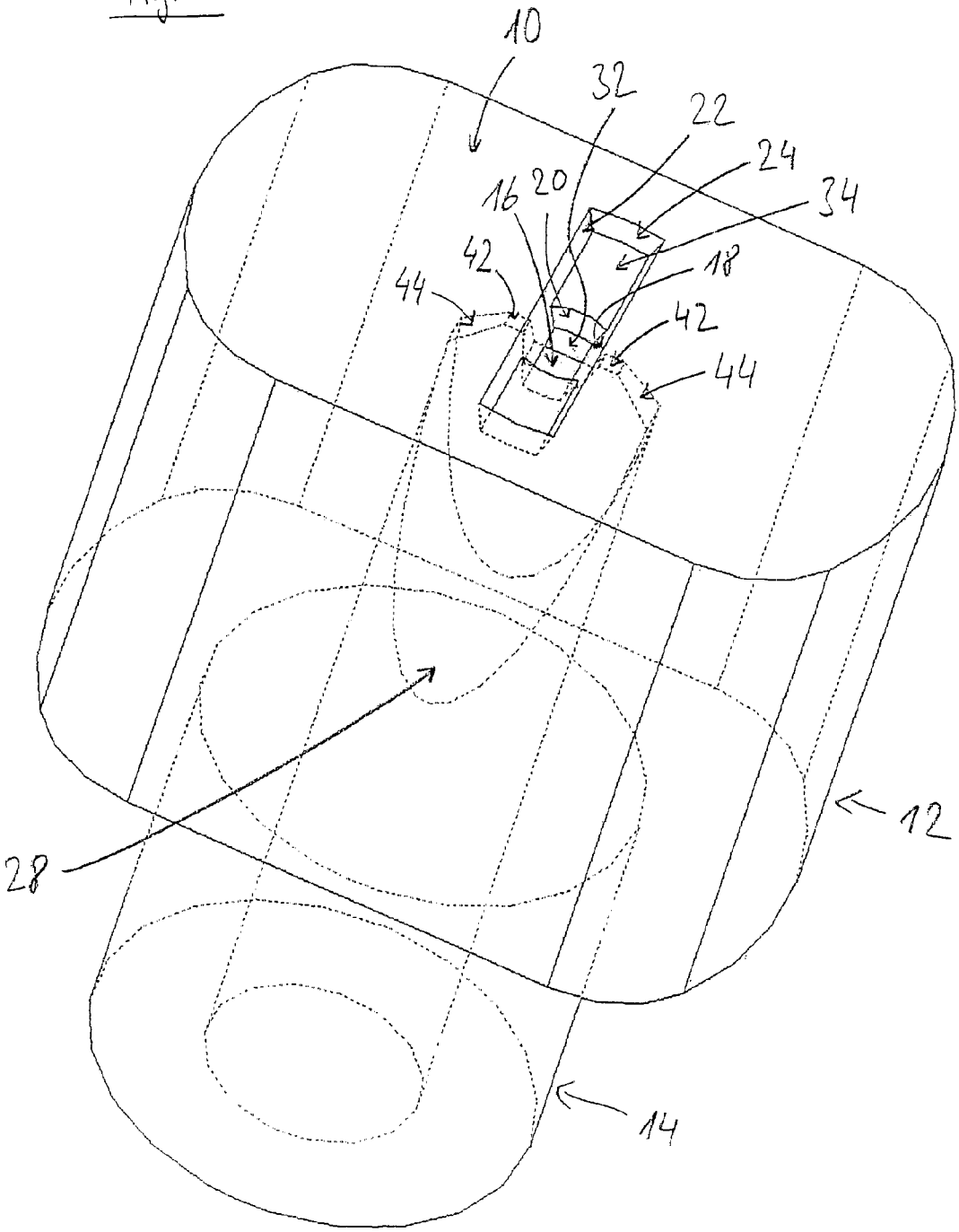
FIG. 7 shows a schematic representation of the spray nozzle assembly of FIGS. 5 and 6 in a perspective view.

For a better comprehension, the second embodiment is schematically illustrated once more in a perspective view in FIG. 7 where concealed lines are shown by dots. This view permits to see the two portions 42 and 44 of the narrow cross-sectioned surface 36 and the cross-section of the passage orifice 16 in a particularly distinct way.

The above disclosure is intended to be illustrative and not exhaustive. This description will suggest many variations and alternatives to one of ordinary skill in this art, All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A spray nozzle assembly for atomizing a medium through a nozzle channel, comprising a first channel portion (26) which is tapered by two lateral surfaces (28) facing each other to form an elongate narrow cross-sectioned surface (36); a passage orifice (16) disposed in the narrow cross-sectioned surface (36) a cross-sectional area of which is smaller than is the narrow cross-sectioned surface (36), and a second channel portion adjoining the passage orifice (16) in the direction of medium flow which has two opposed lateral surfaces separating from each other with an increase in distance from the passage orifice (16), whose edges facing the passage orifice (16) extend crosswise to a longitudinal direction of the narrow cross-sectioned surface (36), characterized in that the nozzle channel having the first and second channel portions and the passage orifice (16) is configured inside an integrally formed plastic component, and further characterized in that the second channel portion is confined, between its two lateral surfaces (18), by two bordering surfaces (20) disposed to be approximately perpendicular to a plane of the passage orifice which are at a lateral distance from the passage orifice (16).

2. The spray nozzle assembly according to claim 1, characterized in that the bordering surfaces (20) are arranged approximately on the jacket of an imaginary cylinder the longitudinal axis of which extends perpendicularly to the plane of the passage orifice (16).

3. The spray nozzle assembly according to claim 1, characterized in that the nozzle channel comprises a third channel portion adjoining the second channel portion which has two lateral surfaces (22) each of which extends in the plane of one of the two lateral surfaces (18) of the second channel portion, and which is limited by two bordering surfaces (24) disposed to be approximately perpendicular to the plane of the passage orifice between the two lateral surfaces (22) of the third channel portion which are disposed at a lateral distance from the bordering surfaces (20) of the second channel portion and are farther remote from the passage orifice (16) than those are.

4. The spray nozzle assembly according to claim 3, characterized in that the nozzle channel comprises a fourth channel portion 38 which is cylindrical in cross-section and is disposed in front of the first channel portion (26) in the direction of flow and adjoins the first channel portion.

5. The spray nozzle assembly according to claim 1, characterized in that the narrow cross-sectioned surface (36), on either side of the passage orifice (16), has a portion (42) disposed substantially in the plane of the passage orifice.

6. The spray nozzle assembly according to claim 5, characterized in that the narrow cross-sectioned surface has two further portions (44) which adjoin the two portions (42) of the narrow cross-sectioned surface (36) disposed laterally of the passage orifice, and which are inclined towards the first channel portion (26) from the plane of the passage orifice (16).

7. The spray nozzle assembly according to claim 1, characterized in that two webs (46) project from the narrow cross-sectioned surface (36) adjacent to the passage orifice (16), which extend into the first channel portion (28).

8. The spray nozzle assembly according to claim 7, characterized in that the webs (46) extend in the direction of a lateral surface (18) of the second channel portion each.

9. The spray nozzle assembly according to claim 1, characterized in that the spray nozzle assembly is manufactured from polyoxymethylene (POM), polybutylene terephthalate (PBT), polyethylene terephthalate (PET), polyamide (PA) and/or polypropylene (PP).

10. The spray nozzle assembly according to claim 1, characterized in that the nozzle channel comprises a further channel portion 38 which is cylindrical in cross-section and is disposed in front of the first channel portion (26) in the direction of flow and adjoins the first channel portion.

* * * * *